US010381768B2

(12) United States Patent
Kosmalski et al.

(10) Patent No.: US 10,381,768 B2
(45) Date of Patent: Aug. 13, 2019

(54) CONTACT HOUSING, CONTACT HOUSING RECEPTACLE AND ELECTRICAL CONNECTOR

(71) Applicant: TE Connectivity Germany GmbH, Bensheim (DE)

(72) Inventors: Christoph Kosmalski, Darmstadt (DE); Michael Schall, Heppenheim/Sonderbach (DE); Zoran Stjepanovic, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/992,672

(22) Filed: May 30, 2018

(65) Prior Publication Data

US 2018/0351280 A1 Dec. 6, 2018

(30) Foreign Application Priority Data

May 30, 2017 (DE) ..... 10 2017 111 813

(51) Int. Cl.

| | |
|---|---|
| ***H01R 13/432*** | (2006.01) |
| ***H01R 13/436*** | (2006.01) |
| ***H01R 13/506*** | (2006.01) |
| ***H01R 13/514*** | (2006.01) |

(52) U.S. Cl.

CPC ..... *H01R 13/436* (2013.01); *H01R 13/4362* (2013.01); *H01R 13/506* (2013.01); *H01R 13/514* (2013.01); *H01R 13/432* (2013.01); *H01R 2201/26* (2013.01)

(58) Field of Classification Search

CPC ..... H01R 13/514; H01R 13/4362; H01R 13/4361; H01R 9/2408; H01R 13/436; H01R 13/506; H01R 13/432; H01R 2201/26

USPC ..... 439/752, 717

See application file for complete search history.

(56) References Cited

U.S. PATENT DOCUMENTS

| | | | | |
|---|---|---|---|---|
| 4,729,744 | A * | 3/1988 | Bet | H02B 1/26 439/717 |
| 5,775,954 | A * | 7/1998 | Kerckhof | H01R 13/514 439/701 |
| 5,921,807 | A * | 7/1999 | Okabe | H01R 13/514 439/467 |
| 6,007,386 | A * | 12/1999 | Okabe | H01R 13/42 439/701 |
| 6,116,954 | A * | 9/2000 | Ries | H01R 12/778 439/423 |

(Continued)

FOREIGN PATENT DOCUMENTS

DE 19919547 A1 4/1998

*Primary Examiner* — Gary F Paumen

(74) *Attorney, Agent, or Firm* — Barley Snyder

(57) ABSTRACT

A contact housing for an electrical connector comprises a plurality of electrical contacts and a plurality of contact housing modules in which the plurality of electrical contacts are disposed. The contact housing modules include a first contact housing module and a second contact housing module. The first contact housing module has a first contact securing comb engaging the second contact housing module and securing the contacts in the second contact housing module. The second contact housing module has a second contact securing comb engaging the first contact housing module and securing the contacts in the first contact housing module.

20 Claims, 9 Drawing Sheets

(56) References Cited

U.S. PATENT DOCUMENTS

| | | | | |
|---|---|---|---|---|
| 6,354,887 | B2 * | 3/2002 | Maeda | H01R 13/514<br>439/701 |
| 6,482,035 | B2 * | 11/2002 | Okabe | H01R 4/2433<br>439/596 |
| 7,297,032 | B2 * | 11/2007 | Kobayashi | H01R 13/4361<br>439/595 |
| 7,547,225 | B2 * | 6/2009 | Suemitsu | H01R 13/6271<br>439/374 |
| 7,695,315 | B2 * | 4/2010 | Hitchcock | H01R 13/4223<br>439/541.5 |
| 7,736,197 | B2 * | 6/2010 | Takeda | H01R 13/6456<br>439/680 |
| 8,545,275 | B2 * | 10/2013 | Wang | H01R 13/44<br>439/680 |
| 8,641,448 | B2 * | 2/2014 | Lappoehn | H01R 13/6471<br>439/607.09 |
| 9,022,813 | B2 * | 5/2015 | Wilkner | H01R 13/4361<br>439/701 |
| 2008/0119091 | A1 | 5/2008 | Nishide | |

* cited by examiner

CONTACT HOUSING, CONTACT HOUSING RECEPTACLE AND ELECTRICAL CONNECTOR

CROSS-REFERENCE TO RELATED APPLICATIONS

This application claims the benefit of the filing date under 35 U.S.C. § 119(a)-(d) of German Patent Application No. 102017111813.6, filed on May 30, 2017.

FIELD OF THE INVENTION

The present invention relates to an electrical connector and, more particularly, to a contact housing of an electrical connector.

BACKGROUND

Known electrical connectors transfer electrical currents, voltages, signals, and data with a large bandwidth of currents, voltages, frequencies, and data rates. In low, medium, or high voltage or current ranges, and in particular in the automotive industry, such connectors must guarantee the transfer of electrical power, signals, and data in hot, contaminated, humid, or chemically aggressive environments. Due to the large range of applications, a large number of specifically configured connectors are known.

Known electrical connectors throughout the range of applications have housings assembled with an electrical member, such as an electrical cable or a circuit board of an electrical component, for mating with a mating electrical connector. An electrical connector must reliably secure an electrical contact within the housing for connecting to the electrical member. Furthermore, the electrical connector must reliably transmit electrical signals, and consequently, known electrical connectors have fasteners for releasably fastening to the mating electrical connector.

Constant efforts are being made to improve electrical contacts and electrical connectors to be more cost-effective. For example, in certain applications, such as a high-voltage connector for sensor applications, increased safety requirements are to be met for hybrid vehicles and electric vehicles. These safety requirements relate to air and creepage distances, as well as a finger guard required for a signal contact.

In the prior art, as shown in FIGS. 1 and 2, a two-rowed plug connector for a typical low-voltage application has two laterally molded-on secondary contact securing devices 80 on its integral contact housing 8. A plurality of electrical contacts are latched inside the contact housing 8. The secondary contact securing device 80 has a lateral slider and is used to further secure the contacts in the housing 8. If two adjacent contacts bear against the secondary contact securing devices 80, a creepage distance is an air distance 82 between the contacts. The creepage distance 82 can only be increased by increasing a spacing of the contacts in the longitudinal direction, which has a negative impact on an installation space of the connector in the longitudinal direction.

A minimum width of the contact housing 8 with the secondary contact securing devices 80 is approximately 7 mm. As shown in FIGS. 3 and 4, a flange width which results therefrom, without an external ribbing 92 for reinforcement, is approximately 9 mm on a plug interface of a contact housing receptacle 9. This flange width has a negative impact on a finger guard of the contact housing receptacle 9. A minimum spacing between a test finger 6 and a free end of an electrical contact is approximately 1.4 mm in this dimensional example as shown in FIGS. 3 and 4. Due to the continuous lateral sliders of the contact housing 8, the lateral walls of the contact housing receptacle 9 can only be stabilized from the inside against a deflection in the event of a finger being inserted to a limited extent by short inner reinforcing ribs 90. Additional measures such as the external ribbing 92 are necessary on the outside of the contact housing receptacle 9 to stabilize against deflection, which has a further negative impact on a width and height of the installation space of the connector.

SUMMARY

A contact housing for an electrical connector comprises a plurality of electrical contacts and a plurality of contact housing modules in which the plurality of electrical contacts are disposed. The contact housing modules include a first contact housing module and a second contact housing module. The first contact housing module has a first contact securing comb engaging the second contact housing module and securing the contacts in the second contact housing module. The second contact housing module has a second contact securing comb engaging the first contact housing module and securing the contacts in the first contact housing module.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
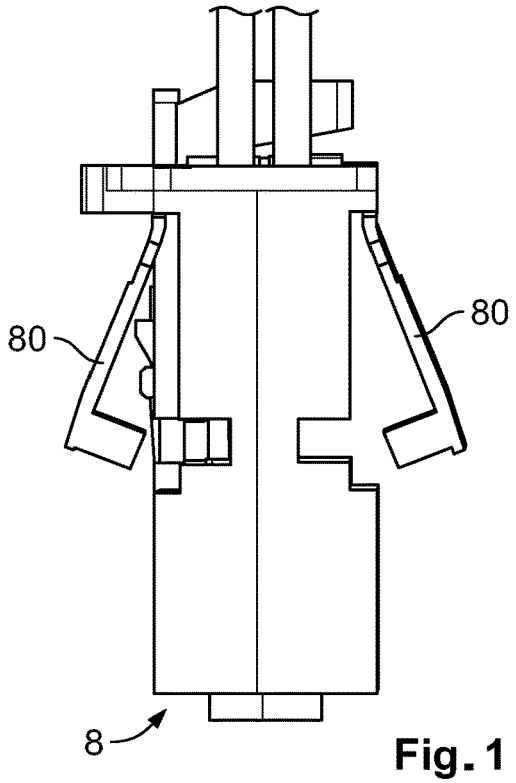
Fig. 1 (Prior art)
FIG. 1 is a top view of a contact housing known in the art.
Figure 2:
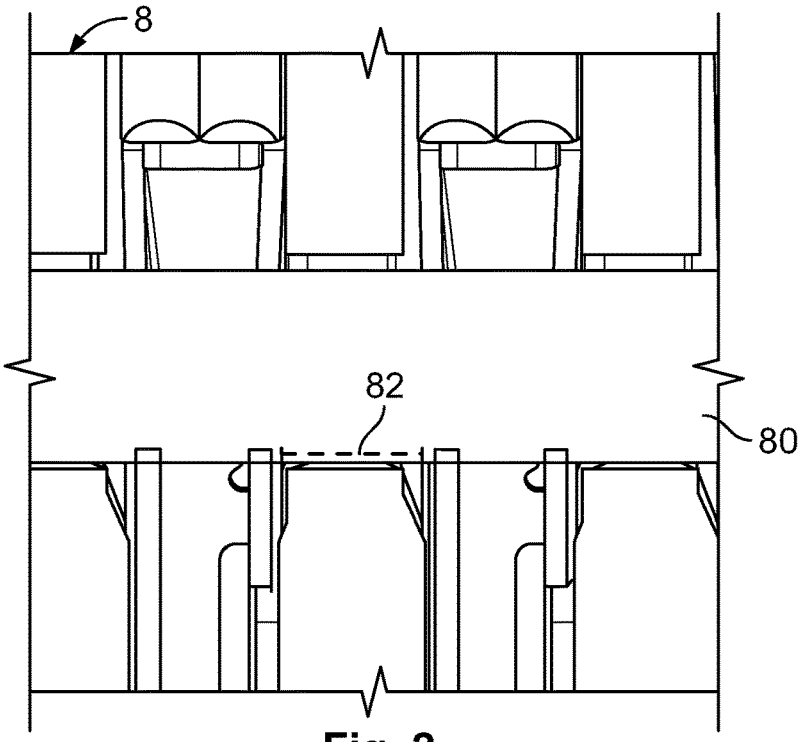
Fig. 2 (Prior art)
FIG. 2 is a detail side view of the contact housing of FIG. 1.
Figure 3:
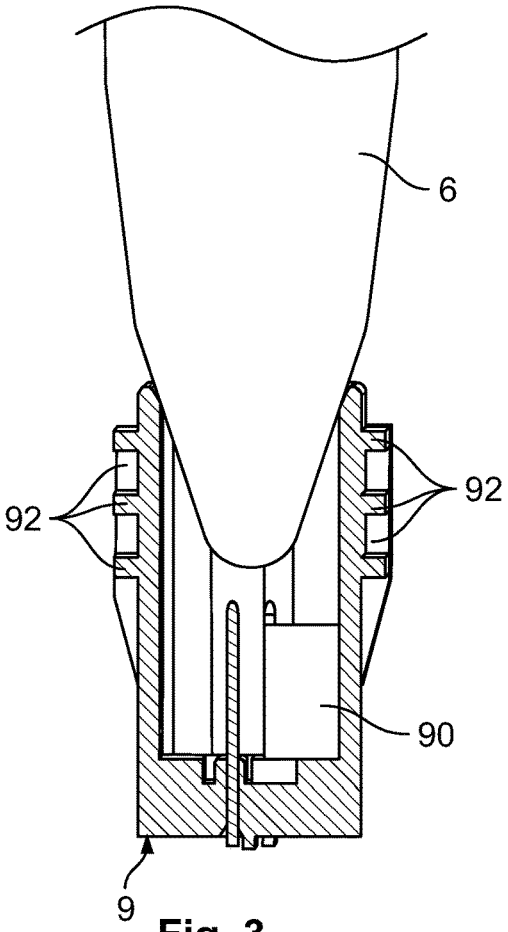
Fig. 3 (Prior art)
FIG. 3 is a sectional side view of a contact housing receptacle known in the art.
Figure 4:
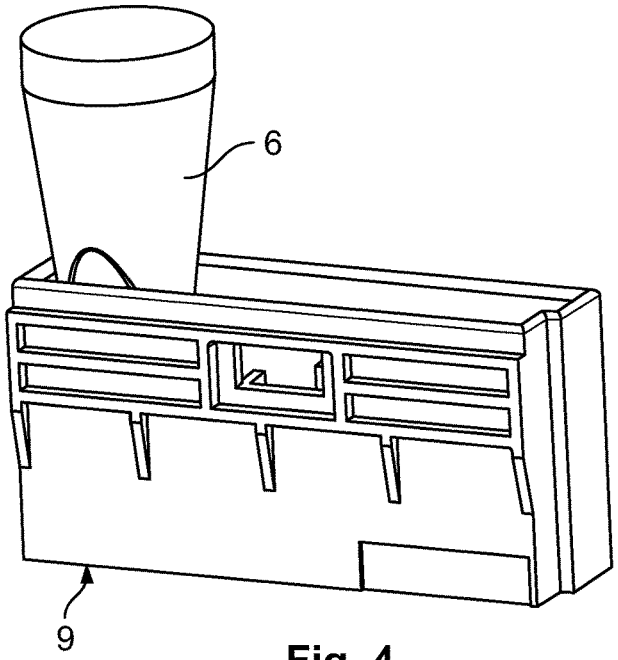
Fig. 4 (Prior art)
FIG. 4 is a perspective view of the contact housing receptacle of FIG. 3.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A contact housing 1 according to an embodiment is shown in FIGS. 7-16. The contact housing 1 is used in an electrical connector, and in an embodiment, the electrical connector is a plug connector. In an embodiment, the plug connector is used in the automotive industry, for example, in a hybrid or electric vehicle. In other embodiments, the contact housing 1 can apply to a socket connector or a plug receptacle.

The contact housing 1, as shown in FIGS. 5-16, includes a pair of contact housing modules 10, 20 separated from one another. The pair of contact housing modules 10, 20 include a first contact housing module 10 and a second contact housing module 20. The pair of contact housing modules 10, 20, when connected or plugged together, form the contact housing 1. In other embodiments, the contact housing 1 may include more than two contact housing modules 10, 20 that are mechanically coupled to one another and arranged in series. In an embodiment, each of the contact housing modules 10, 20 is produced by injection molding in a mold that has two different demolding directions. The contact housing modules 10, 20 can also be produced separate from one another in two separate molds. In an embodiment, the first contact housing module 10 and the second contact housing module 20 are each monolithically formed from a single piece.

A plurality of contacts 30, shown in FIGS. 12-15, are disposed in and locked in the contact housing 1. In an embodiment, the contacts 30 are each a Nano Micro Quadlock System ("NanoMQS") having a square contact cross-section in a region of contact with a mating contact 60 shown in FIG. 17. In other embodiments, the contacts 30 are pin, peg, or tab contacts. The contact housing 1 formed by the contact housing modules 10, 20 has multiple rows for contacts 30. In an embodiment, the contact housing modules 10, 20 are NanoMQS modules 10, 20. In other embodiments, it is possible to combine different contact systems, such as NanoMQS and Multiple Contact ("MCON"), in the contact housing 1.

The contact housing modules 10, 20, as shown in FIGS. 5, 6, 12, and 13, each have a substantially cuboid base body 100, 200, in which a plurality of contact chambers 110, 120 are provided for the contacts 30. In an embodiment, the contact housing modules 10, 20 are interchangeable. The contact chambers 110, 120 of a contact housing module 10, 20 are electrically isolated from one another in a longitudinal direction L by divider walls of the respective contact housing module 10, 20. A contact 30 is disposed in each of the contact chambers 110, 120.

Figure 5:
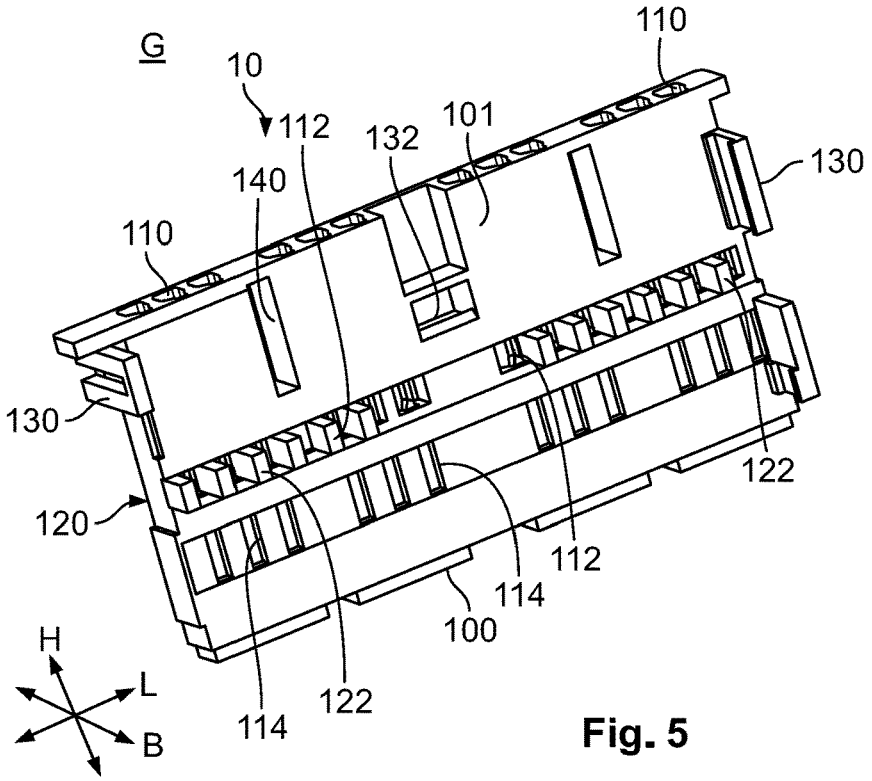
FIG. 5 is a perspective view of a first contact housing module of a contact housing according to an embodiment of the invention.
Figure 6:
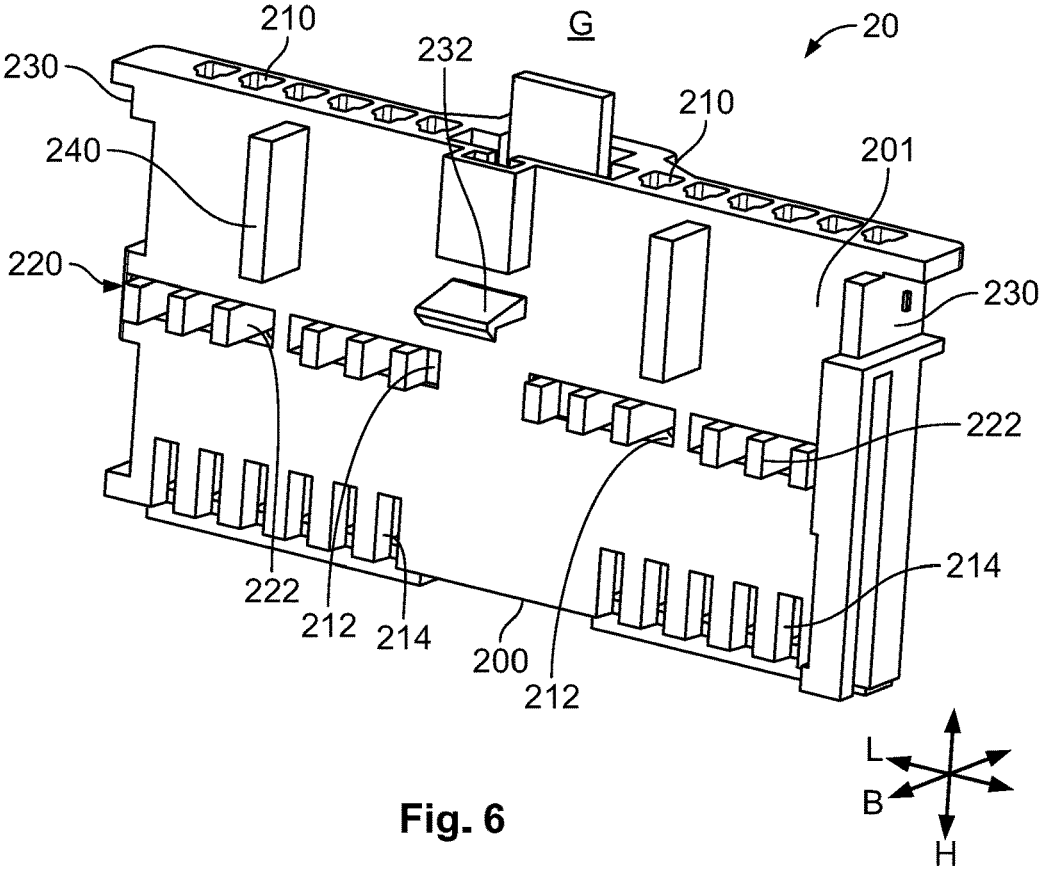
FIG. 6 is a perspective view of a second contact housing module of the contact housing of FIG. 5.

To assemble the contact housing modules 10, 20, the modules 10, 20 start in a separated position G shown in FIGS. 5 and 6 and are positioned opposite one another. For a delivery condition, the contact housing modules 10, 20 are in a pre-latching position V or a preassembly position V to one another, shown in FIGS. 7, 9 and 10. In the pre-latching position V, a gap is disposed between inner sides 101, 201 of the base bodies 100, 200, which is required for establishing secondary contact securing devices 120, 220 as described in greater detail below.

Figure 7:
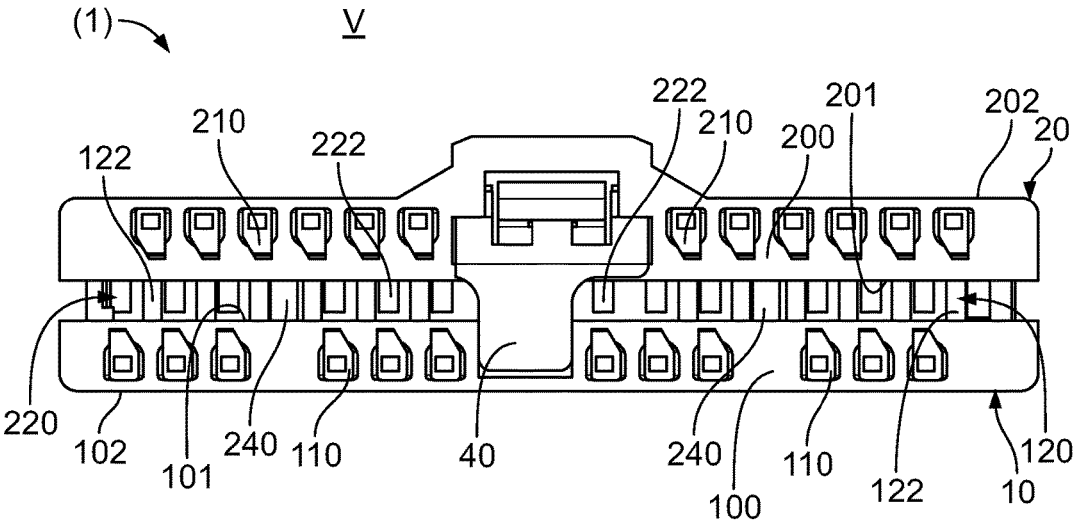
FIG. 7 is a top view of the contact housing modules of FIGS. 5 and 6 in a pre-latching position.
Figure 9:
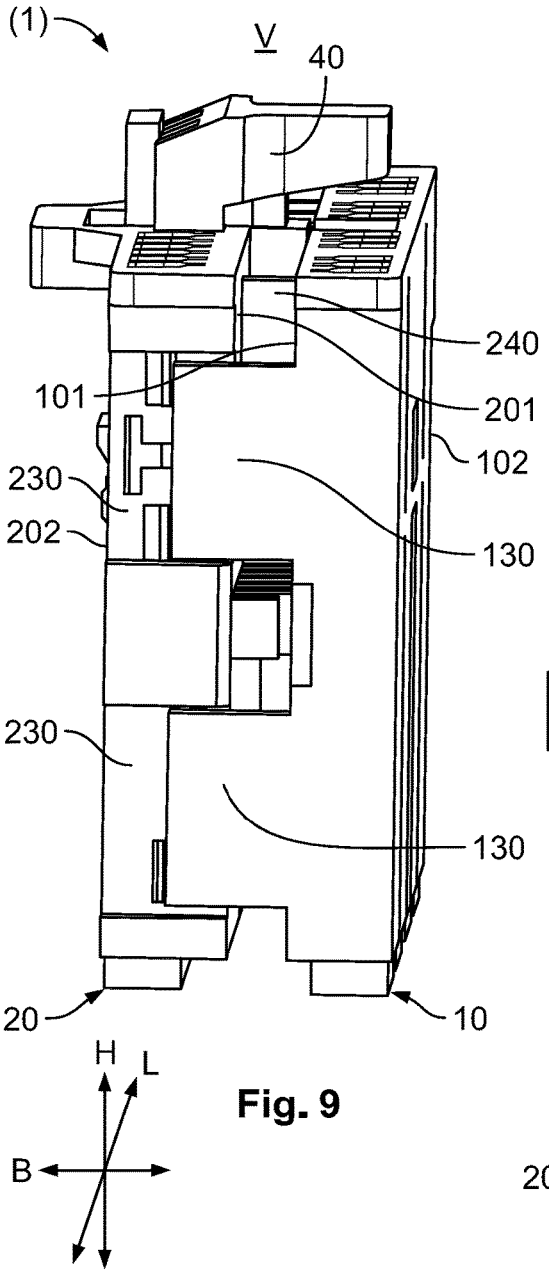
FIG. 9 is a perspective view of the contact housing modules of FIGS. 5 and 6 in the pre-latching position.
Figure 10:
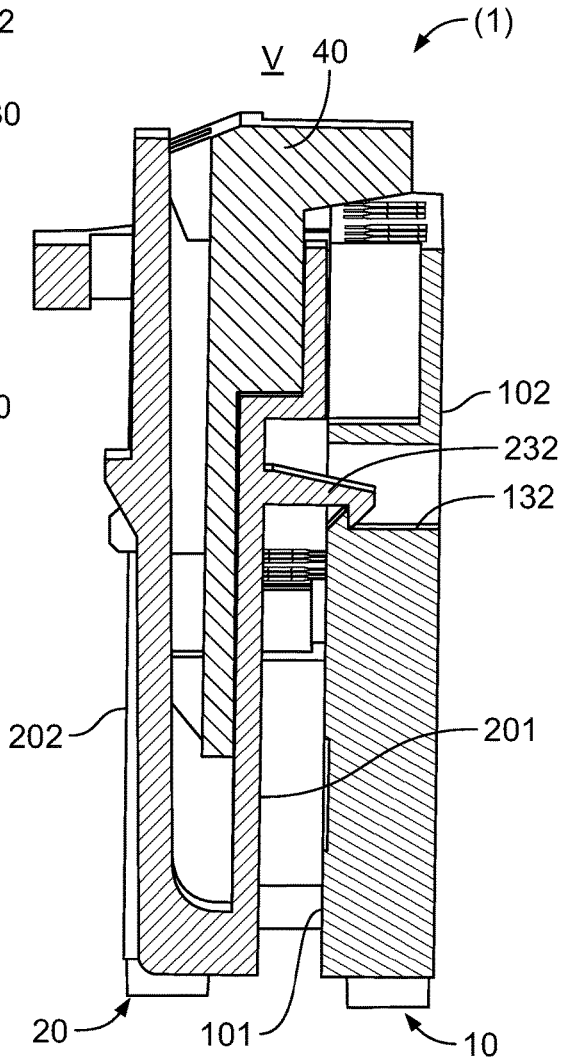
FIG. 10 is a sectional side view of the contact housing modules of FIGS. 5 and 6 in the pre-latching position.
Figure 11:
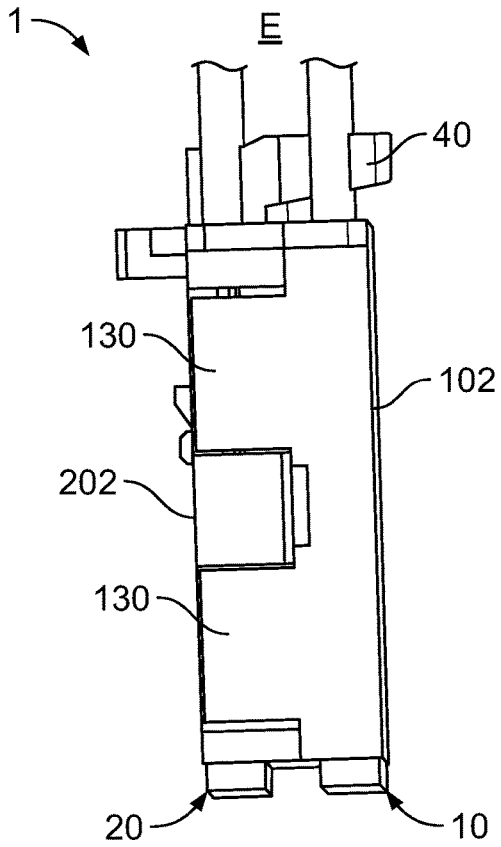
FIG. 11 is a front view of the contact housing modules of FIGS. 5 and 6 in the final latching position.

The two base bodies 100, 200 are pre-latched to one another in the pre-latching position V shown in FIGS. 7, 9, and 10 by latches 130, 230 of the contact housing modules 10, 20. The latches 130, 230 are formed in sections and are partially complementary. In the pre-latching position V, the latches 130, 230, by means of which a final latching position E or a final assembly position E can also be established, engage one another in a first mutual position. For the final latching position E, the latches 130, 230 and thus the contact housing modules 10, 20 can be brought out of the pre-latching position V into the final latching position E.

In order to transfer the two contact housing modules 10, 20 from the pre-latching position V into the final latching position E, the contact housing modules 10, 20 are mutually guided, in particular forcibly guided in a translatory manner in a width direction B. For this purpose, the contact housing modules 10, 20 have guiding units 140, 240 shown in FIGS. 5 and 6 which are formed at least partially complementary to one another. The guiding unit 140 is formed as a recess 140 in the first contact housing module 10, starting from the inner side 101 thereof, and the guiding unit 240 is formed as a projection 240 on the inner side 201 of the second contact housing module 20. In other embodiments, the recess 140 and projection 240 could be switched and disposed on the opposite contact housing module 10, 20. In the embodiment shown in FIGS. 5 and 6, the guiding units 140, 240 are formed cuboid in shape. In other embodiments, it is possible for the guiding units 140, 240 to have other shapes, such as a straight and generally cylindrical shape, a straight prism, etc. The guiding units 140, 240 partially engage in one another in the pre-latching position V shown in FIG. 7. The guiding units 140, 240 ensure that the two contact housing modules 10, 20 cannot be rotated relative to one another in the pre-latching position V or in the final latching position E.

The contact housing modules 10, 20 are snapped shut from the pre-latching or preassembly position V to the final latching or final assembly position E. The formed contact housing 1 has a maximum outer dimension in the width direction B of 6.5 mm, 6.3 mm, 6.1 mm, 5.9 mm, 5.7 mm, 5.5 mm or 5.3 mm.

In the separated position G and/or the pre-latching position V, the contact housing 1 or the contact housing modules 10, 20 are fitted with the contacts 30. An electrical conductor or an electrical cable is mechanically and electrically connected to the contacts 30, as shown in FIGS. 11-13 and 16, to form a ready-made electrical cable. When fitting in the contact housing modules 10, 20, the contact 30 latches in a front region shown in FIGS. 12 and 13 to a latching shoulder on/in a related contact chamber 110, 210; the contact 30 has a latching bracket formed thereon for primary securing of the contact 30 to the latching shoulder.

Figure 12:
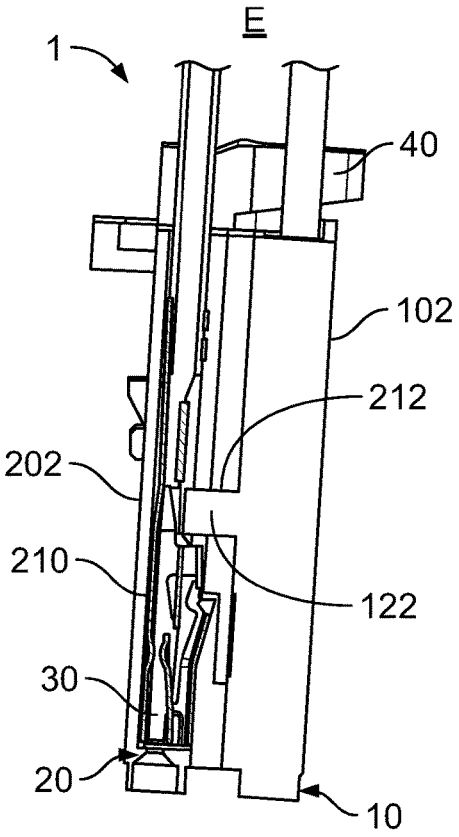
FIG. 12 is a sectional front view of the contact housing modules of FIGS. 5 and 6 with a contact of the contact housing.
Figure 13:
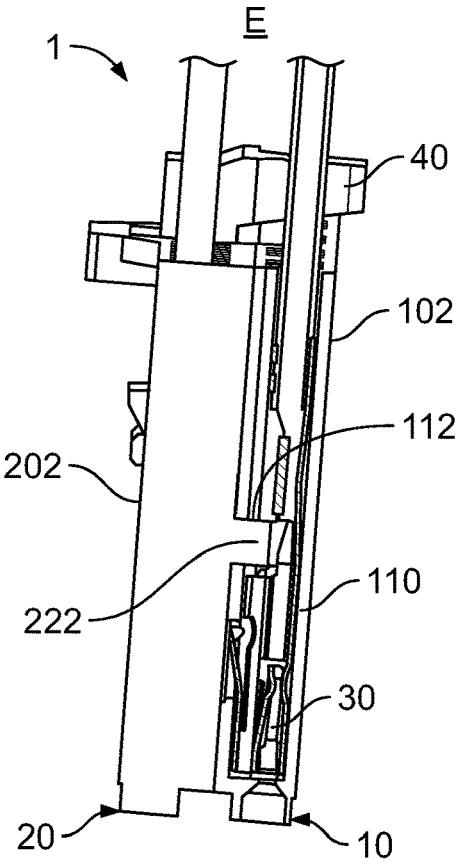
FIG. 13 is a sectional front view of the contact housing modules of FIGS. 5 and 6 with the contact.

As shown in FIGS. 12 and 13, a secondary contact securing device 120, 220 provides secondary securing of the contact 30 in the contact housing 1. The secondary securing of the contact 30 in each housing module 10, 20 is performed by the other housing module 10, 20; the secondary securing of contact 30 of the first contact housing module 10 takes place by the second contact housing module 20, and the secondary securing of contact 30 of the second contact housing module 20 takes place by the first contact housing module 10.

The secondary contact securing device 220, 120, as shown in FIGS. 5-8, 12, and 13, is formed as a contact securing comb 220, 120, which secondarily mechanically secures substantially all contacts 30 of a contact housing module 10, 20, which is substantially opposite it in the width direction B. The contact securing comb 220, 120 engages in the opposite contact housing module 10, 20 with a plurality of contact securing teeth 222, 122. The contact securing teeth 222, 122 engage behind the respective contacts 30 of a related contact housing module 10, 20, behind the latching bracket of the contact 30 and on a latching shoulder which is formed integrally on the contact 30. The first contact housing module 10 has a first contact securing comb 120 and the second contact housing module 20 has a second contact securing comb 220. In the shown embodiment, the contact securing teeth 122, 222 are all located in a same plane. In an embodiment, the contact securing teeth 122, 222 of the contact securing combs 120, 220 do not have to be located on one plane, as different positions of a secondary contact securing device 120, 220 can be applied from contact chamber 110, 210 to contact chamber 110, 210.

When establishing the secondary contact securing device 220, 120 or when bringing the contact housing modules 10, 20 out of the separated position G or the pre-latching position V into the final latching position E, the contact securing teeth 222, 122 penetrate respective secondary latching passageways 112, 212 of the opposite contact housing module 10, 20 shown in FIGS. 5, 6, 8, 12, 13, and 15. The secondary latching passageway 112, 212 communicates with the contact chamber 110, 210 of the respective contact housing module 10, 20. A part of the contact securing teeth 222, 122, in particular substantially all contact securing teeth 222, 122 of an individual contact housing module 10, 20, project somewhat into the secondary latching passageways 212, 112 in the pre-latching position V. The contact securing teeth 122 of the contact housing module 10 initially project into the secondary latching passageways 212 of the contact housing module 20, without impeding fitting the contact chambers 210 of the contact housing module 20 with the contacts 30 thereof, as shown in FIG. 7. In a counter movement, the protrusion 240 of the contact housing module 20 already projects somewhat into the recess 140 of the contact housing module 10 in the pre-latching position V as shown in FIG. 7.

Figure 8:
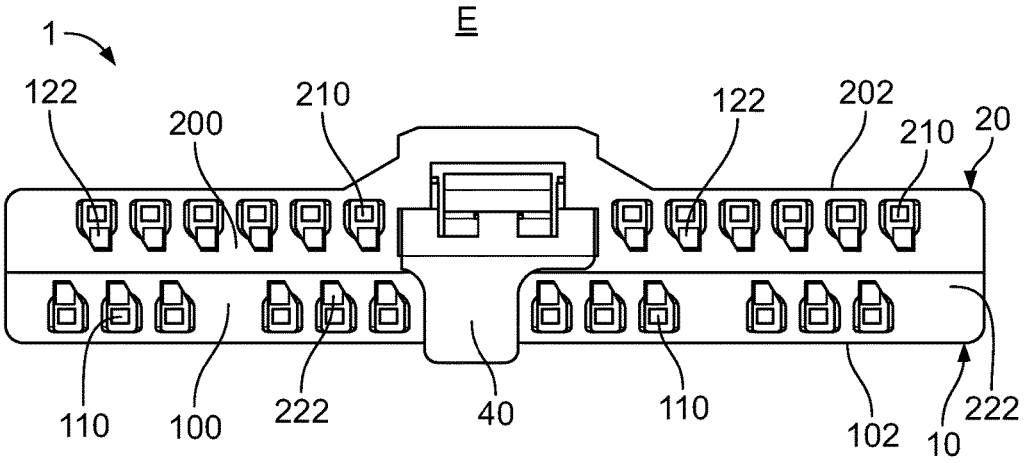
FIG. 8 is a top view of the contact housing modules of FIGS. 5 and 6 in a final latching position.

In the final latching position E, shown in FIG. 8, substantially all contact securing teeth 122, 222 engage through substantially all secondary latching passageways 112, 212 and into substantially all contact chambers 110, 210, and secondarily lock substantially all contacts 30 in the contact housing 1. In the final latching position E, a first final latch 132 of the first contact housing module 10 latches with a second final latch 232 of the second contact housing module 20. The final latches 132, 232 are complementary to one another. In an embodiment, as shown in FIG. 10, the final latches 232, 132 do not yet engage with one another in the pre-latching position V.

Figure 15:
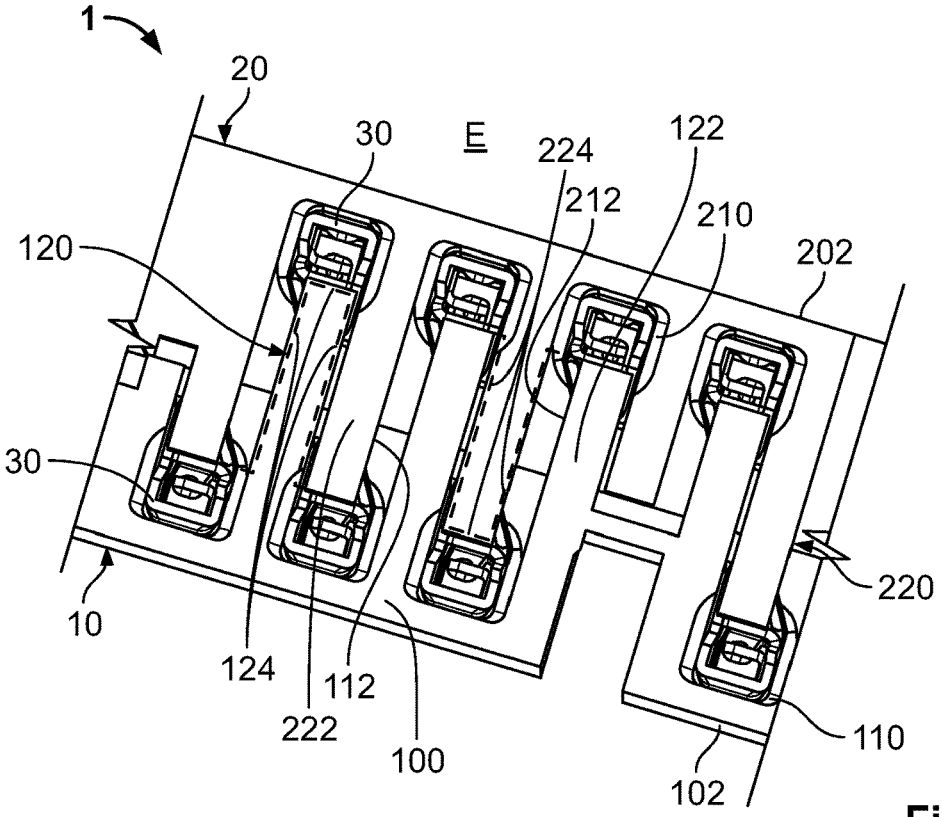
FIG. 15 is a sectional top view of a plurality of contact securing teeth of the contact housing modules.
Figure 16:
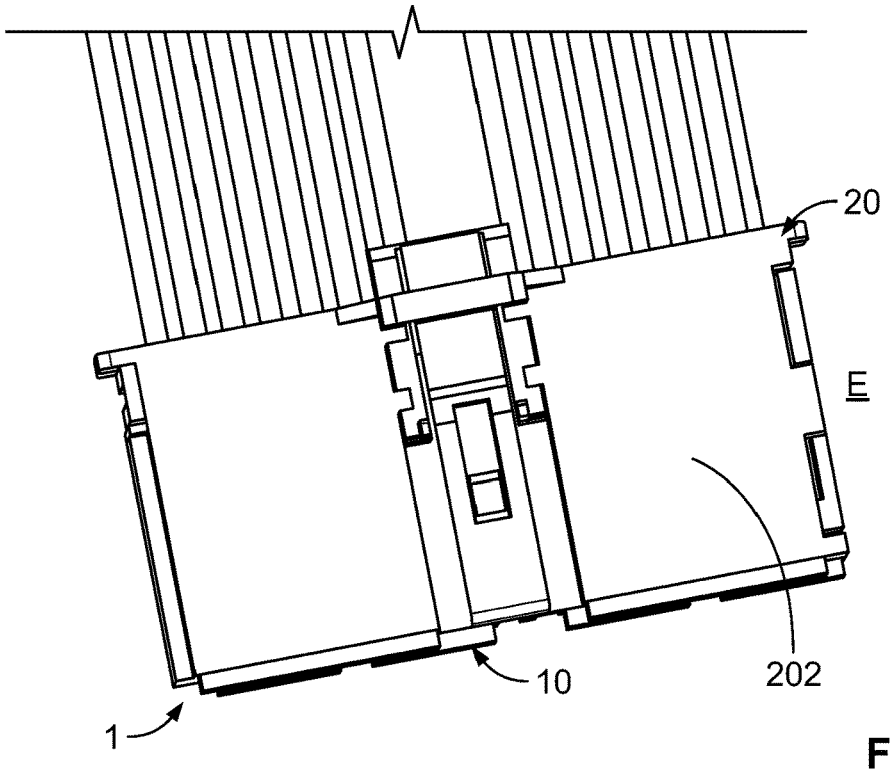
FIG. 16 is a perspective view of an electrical connector connected with a plurality of electrical conductors.

In the final latching position E, creepage distances 124, 224 shown in FIG. 15 are established between two adjacent contacts 30. Longitudinal outer sides 102, 202 of the contact housing modules 10, 20 are formed substantially closed, planar and/or optionally smooth on the outside in the regions of their contacts 30, as shown in FIG. 16. A connector position assurance ("CPA") device 40 (for the contact housing 1 is shown in FIG. 16, which is only plugged into the contact housing 1 if a connector is plugged with the contact housing 1.

Figure 14:
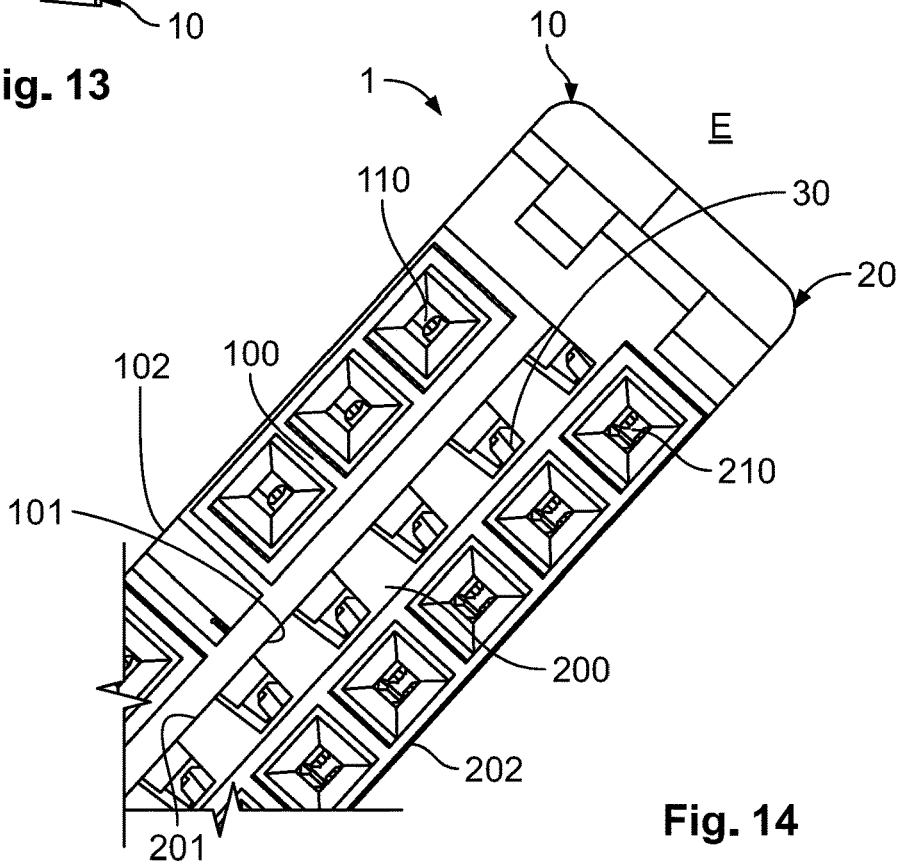
FIG. 14 is a bottom view of the contact housing and a plurality of contacts.

To ensure that the injection molds used for producing the contact housing modules 10, 20 can be demolded well, are not too delicate and thus too prone to damage for the cores or core structures required for the shapes, openings 114, 214 are provided in the inner sides 101, 201 of the contact housing modules 10, 20, which lead into the respective contact chambers 110, 210, as shown in FIGS. 5, 6, and 14. The openings 114, 214 are provided inside the contact housing 1 such that the respective openings 114, 214 of a related contact housing module 10, 20 are completely covered by closed sections of the inner side 201, 101 of the other contact housing module 20, 10, in particular with an inner side overlapping respectively in the longitudinal direction L and/or in the height direction H.

Figure 17:
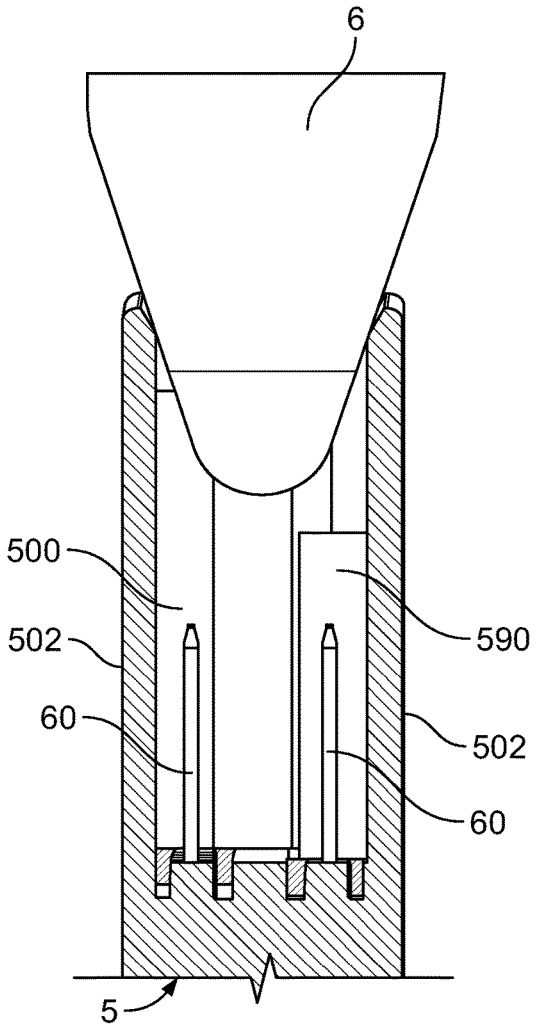
FIG. 17 is a sectional side view of a contact housing receptacle according to the invention.
Figure 18:
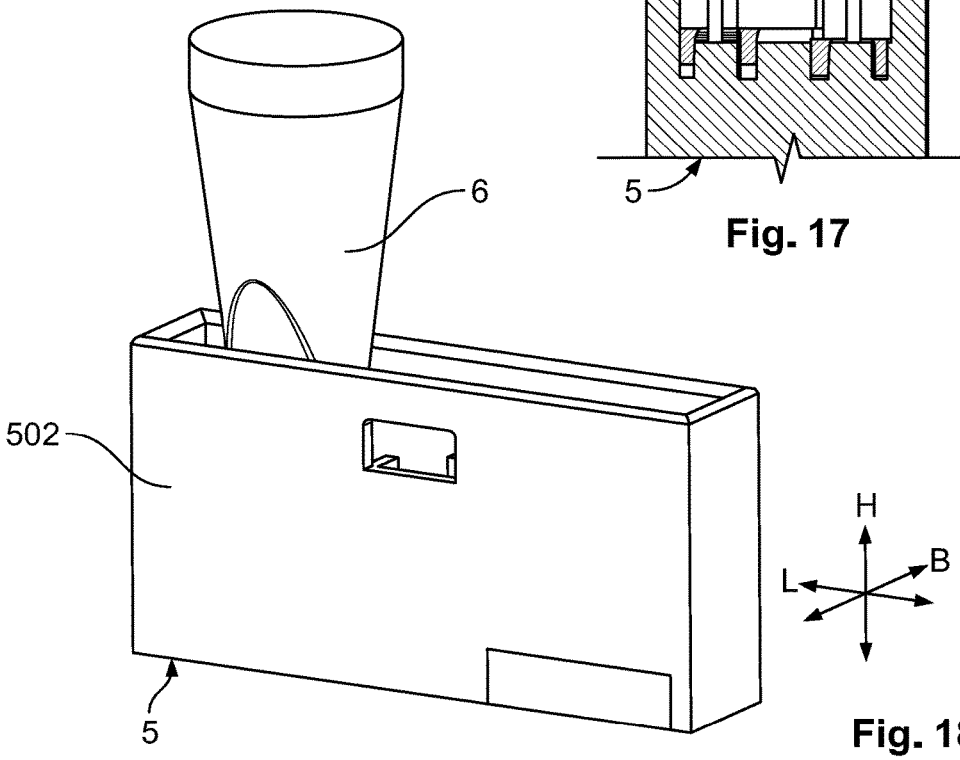
FIG. 18 is a perspective view of the contact housing receptacle of FIG. 17.

In an embodiment shown in FIGS. 17 and 18, the contact housing 1 is part of a contact housing receptacle 5. The contact housing receptacle 5 can be formed as a flange terminal 5 or a header 5. A plurality of contacts 60 which can be locked in the contact housing receptacle 5 are pin or peg contacts 60, but can alternatively be socket and/or tab contacts. In an embodiment, the contact housing receptacle 5 is an integral part of a connector.

The contact housing receptacle 5, as shown in FIG. 17, encloses a receiving space 500, into which the contact housing 1 or a connector with such a contact housing 1 can be plugged. In the receiving space 500, at least two rows of contacts 60 are established with their contacting sections in a projecting manner. Between two electrical contacts 60, which are directly adjacent to one another, of at least one row, an inner reinforcing rib 590 is formed in the receiving space 500. The inner reinforcing rib 590 is formed such that the inner reinforcing rib 590 projects beyond two contacts 60 which are directly adjacent to one another. The inner reinforcing rib 590 can further be formed such that the inner reinforcing rib 590 terminates substantially at the same height as at least one of these contacts 60. In the shown embodiment, a minimum spacing between a test finger 6 on an outer edge of the contact housing receptacle 5 and the free ends of the contacts 60 is approximately 3.9 mm. The contact housing receptacle 5 is formed such that a minimum spacing between the test finger 6 and a free end of the electrical contact 60 is greater than or equal to: 2.5 mm, 3 mm, 3.5 mm, 3.75 mm, 4 mm or 4.25 mm. A maximum outer dimension of the contact housing receptacle 5 in the width direction B is less than or equal to: 8.5 mm, 8.3 mm, 8.1 mm, 7.9 mm, 7.7 mm, 7.5 mm or 7.3 mm.

In the contact housing 1, a plug width of approximately 5.7 mm is implemented, which significantly improves a finger guard in a contact housing receptacle 5 and provides significant installation space advantages, particularly in flat applications. By the teeth 122, 222 of the secondary contact securing device 120, 220, the creepage distances are significantly extended, which, in turn, in the case of increased demands concerning creepage distances between two directly adjacent electrical contacts 30, represents installation space advantages in terms of the length of the contact housing 1. The two contact housing modules 10, 20 can be produced more easily and can be supplied in the pre-latching position V. As a result, no disadvantages arise for a user as compared with a one-part solution with regard to handling and processing.

In the contact housing receptacle 5, the contact housing 1 permits stabilization of the extensive lateral walls against deflection in the event of a finger being inserted (see below). Furthermore, the rows of the electrical contacts 60 can be positioned nearer to the extensive lateral walls, which has a positive impact on the finger guard and on safety when obliquely bringing together two electrical connectors. By laying the rows of electrical contacts 60 from the center outwards, by a reduced flange width of approximately 7.7 mm, and/or by reinforcing the extensive lateral walls from the inside, the finger guard on the contact housing receptacle 5 is significantly improved.

What is claimed is:

1. A contact housing for an electrical connector, comprising:

a plurality of electrical contacts; and a plurality of contact housing modules in which the plurality of electrical contacts are disposed, the contact housing modules including a first contact housing module and a second contact housing module, the first contact housing module having a first contact securing comb engaging the second contact housing module and securing the contacts in the second contact housing module, and the second contact housing module having a second contact securing comb engaging the first contact housing module and securing the contacts in the first contact housing module, the first contact securing comb is at least partially engageable in the second contact securing comb and/or, in a preassembly position of the first contact housing module and the second contact housing module, the first contact securing comb engages a second base body of the second contact housing module and the second contact securing comb engages a first base body of the first contact housing module.

2. The contact housing of claim 1, wherein the first contact housing module and the second contact housing module are formed separate from one another.

3. The contact housing of claim 2, wherein the first contact housing module and the second contact housing module are movable toward each other in a preassembly position and are releasably fixed to each other in a final assembly position.

4. The contact housing of claim 3, wherein the first contact housing module and the second contact housing module are snapped shut from the preassembly position to the final assembly position.

5. The contact housing of claim 1, wherein the first contact securing comb and the second contact securing comb provide secondary securing of the contacts.

6. The contact housing of claim 1, wherein the first contact securing comb and the second contact securing comb each have a plurality of contact securing teeth arranged in a same plane.

7. The contact housing of claim 1, wherein the first contact securing comb and the second contact securing comb each have a plurality of contact securing teeth arranged in different planes.

8. The contact housing of claim 1, wherein each of the first contact housing module and the second contact housing module has a plurality of contact chambers each receiving an electrical contact and a plurality of secondary latching passageways each leading into one of the contact chambers.

9. The contact housing of claim 8, wherein each of the first contact housing module and the second contact housing module has a plurality of contact securing teeth protruding from an inner side between each pair of adjacent contact chambers or each pair of adjacent secondary latching passageways.

10. The contact housing of claim 3, wherein, in the final assembly position of the first contact housing module and the second contact housing module, a creepage distance between two adjacent contacts extends along a contact securing tooth disposed between the two adjacent contacts.

11. The contact housing of claim 9, wherein the first contact housing module and the second contact housing module each have a plurality of openings on the inner side spaced apart from the secondary latching passageways and open to the plurality of contact chambers.

12. The contact housing of claim 11, wherein the contact chambers of each of the first contact housing module and the second contact housing module are electrically isolated by a closed portion of the inner side of the other of the first contact housing module and the second contact housing module.

13. The contact housing of claim 3, wherein the first contact housing module and the second contact housing module are pre-latched to each other in the preassembly position by a plurality of latches and are latched to each other in the final assembly position by the latches.

14. The contact housing of claim 3, wherein the first contact housing module and the second contact housing module are guided with respect to each other between the preassembly position and the final assembly position by a plurality of guiding units.

15. The contact housing of claim 1, wherein a maximum outer dimension of the contact housing in a width direction is less than or equal to 6.5 mm, the contacts are all identical, an outer side of each of the first contact housing module and the second contact housing module is substantially closed, and/or the first contact housing module and the second contact housing module are each monolithically formed from a single piece.

16. An electrical connector, comprising:

a plurality of electrical contacts; and a contact housing including a plurality of contact housing modules in which the plurality of electrical contacts are disposed, the contact housing modules including a first contact housing module and a second contact housing module, the first contact housing module having a first contact securing comb engaging the second contact housing module and securing the contacts in the second contact housing module, and the second contact housing module having a second contact securing comb engaging the first contact housing module and securing the contacts in the first contact housing module, the first contact securing comb is at least partially engageable in the second contact securing comb and/or, in a preassembly position of the first contact housing module and the second contact housing module, the first contact securing comb engages a second base body of the second contact housing module and the second contact securing comb engages a first base body of the first contact housing module.

17. A ready-made electrical cable, comprising:

an electrical connector including a plurality of electrical contacts and a contact housing, the contact housing including a plurality of contact housing modules in which the plurality of electrical contacts are disposed, the contact housing modules including a first contact housing module and a second contact housing module, the first contact housing module having a first contact securing comb engaging the second contact housing module and securing the contacts in the second contact housing module, and the second contact housing module having a second contact securing comb engaging the first contact housing module and securing the contacts in the first contact housing module, the first contact securing comb is at least partially engageable in the second contact securing comb and/or, in a preassembly position of the first contact housing module and the second contact housing module, the first contact securing comb engages a second base body of the second contact housing module and the second contact securing comb engages a first base body of the first contact housing module; and an electrical cable electrically connected to the electrical contacts.

18. A contact housing for an electrical connector, comprising:

a plurality of electrical contacts; and a plurality of contact housing modules in which the plurality of electrical contacts are disposed, the contact housing modules including a first contact housing module and a second contact housing module, the first contact housing module having a first contact securing comb engaging the second contact housing module and securing the contacts in the second contact housing module, and the second contact housing module having a second contact securing comb engaging the first contact housing module and securing the contacts in the first contact housing module, each of the first contact housing module and the second contact housing module has a plurality of contact chambers each receiving an electrical contact, a plurality of secondary latching passageways each leading into one of the contact chambers, a plurality of contact securing teeth protruding from an inner side between each pair of adjacent contact chambers or each pair of adjacent secondary latching passageways, and a plurality of openings on the inner side spaced apart from the secondary latching passageways and open to the plurality of contact chambers.

19. The contact housing of claim 18, wherein the contact chambers of each of the first contact housing module and the second contact housing module are electrically isolated by a closed portion of the inner side of the other of the first contact housing module and the second contact housing module.

20. A contact housing for an electrical connector, comprising:

a plurality of identical electrical contacts; and a plurality of contact housing modules in which the plurality of electrical contacts are disposed, the contact housing modules including a first contact housing module and a second contact housing module, the first contact housing module having a first contact securing comb engaging the second contact housing module and securing the contacts in the second contact housing module, and the second contact housing module having a second contact securing comb engaging the first contact housing module and securing the contacts in the first contact housing module, a maximum outer dimension of the contact housing in a width direction is less than or equal to 6.5 mm, an outer side of each of the first contact housing module and the second contact housing module is substantially closed, and the first contact housing module and the second contact housing module are each monolithically formed from a single piece.

* * * * *